US011756558B2

(12) United States Patent
Bonada et al.

(10) Patent No.: US 11,756,558 B2
(45) Date of Patent: Sep. 12, 2023

(54) SOUND SIGNAL GENERATION METHOD, GENERATIVE MODEL TRAINING METHOD, SOUND SIGNAL GENERATION SYSTEM, AND RECORDING MEDIUM

(71) Applicant: YAMAHA CORPORATION, Hamamatsu (JP)

(72) Inventors: Jordi Bonada, Barcelona (ES); Merlijn Blaauw, Barcelona (ES); Ryunosuke Daido, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 190 days.

(21) Appl. No.: 17/405,473

(22) Filed: Aug. 18, 2021

(65) Prior Publication Data

US 2021/0383816 A1 Dec. 9, 2021

Related U.S. Application Data

(63) Continuation of application No. PCT/JP2020/006160, filed on Feb. 18, 2020.

(30) Foreign Application Priority Data

Feb. 20, 2019 (JP) ..... 2019-028682

(51) Int. Cl.
*G10L 19/02* (2013.01)
*G10H 7/08* (2006.01)
*G10L 13/02* (2013.01)

(52) U.S. Cl.
CPC ..... *G10L 19/02* (2013.01); *G10H 7/08* (2013.01); *G10L 13/02* (2013.01)

(58) Field of Classification Search
CPC ..... G10L 19/02; G10L 13/02; G10L 13/0335; G10L 21/013; G10H 7/08; G10H 1/057;
(Continued)

(56) References Cited

U.S. PATENT DOCUMENTS 9,286,906 B2 3/2016 Bonada
10,878,801 B2 * 12/2020 Tamura ..... G10L 13/0335
(Continued)

FOREIGN PATENT DOCUMENTS

GB 2480108 A * 11/2011 ..... G10L 13/04
JP 2005134685 A * 5/2005
(Continued)

OTHER PUBLICATIONS

Office Action issued in Japanese Appln. No. 2021-501995 dated Dec. 7, 2021. English machine translation provided.
(Continued)

*Primary Examiner* — Bhavesh M Mehta
*Assistant Examiner* — Philip H Lam
(74) *Attorney, Agent, or Firm* — ROSSI, KIMMS & McDOWELL LLP

(57) ABSTRACT

A computer-implemented sound signal generation method includes: obtaining a first sound source spectrum of a sound signal to be generated; obtaining a first spectral envelope of the sound signal; and estimating fragment data representative of samples of the sound signal based on the obtained first sound source spectrum and the obtained first spectral envelope.

8 Claims, 7 Drawing Sheets

(58) Field of Classification Search
CPC ..... G10H 2210/041; G10H 2210/066; G10H 2210/325; G10H 2250/031; G10H 2250/235
See application file for complete search history.

(56) References Cited

U.S. PATENT DOCUMENTS

| | | | | |
|---|---|---|---|---|
| 2013/0173275 | A1* | 7/2013 | Liu | G10L 19/24 704/500 |
| 2019/0156843 | A1* | 5/2019 | Multrus | G10L 19/26 |

FOREIGN PATENT DOCUMENTS

| | | | |
|---|---|---|---|
| JP | 5772739 | B2 | 9/2015 |
| PT | 1864101 | E * | 10/2012 |
| WO | 2012053150 | A1 | 4/2012 |

OTHER PUBLICATIONS

English translation of Written Opinion issued in Intl. Appln. No. PCT/JP2020/006160 dated May 26, 2020, previously cited in IDS filed Aug. 18, 2021.
International Search Report issued in Intl. Appln. No PCT/JP2020/006160 dated May 26, 2020. English translation provided.
Written Opinion issued in Intl. Appln. No. PCT/JP2020/006160 dated May 26, 2020.
Wang. "Neural Source-Filter-Based Waveform Model for Statistical Parametric Speech Synthesis." arXiv:18100.11946v4 [eess.AS] Apr. 27, 2019. Cited in NPL 1 and NPL 2.
Morise. "World: A Vocoder-Based High-Quality Speech Synthesis System for Real-Time Applications." IEICE Transactions on Information and Systems. Jul. 2016: 1877-1884. vol. E99-D, No. 7. Cited in Specification.
Tamamori. "Speaker-dependent WaveNet vocoder." Interspeech. 2017: 1118-1122. Cited in Specification.

* cited by examiner mel-spectrogram

SOUND SIGNAL GENERATION METHOD, GENERATIVE MODEL TRAINING METHOD, SOUND SIGNAL GENERATION SYSTEM, AND RECORDING MEDIUM

CROSS REFERENCE TO RELATED APPLICATIONS

This Application is a Continuation Application of PCT Application No. PCT/JP2020/006160, filed on Feb. 18, 2020, and is based on and claims priority from Japanese Patent Application No. 2019-028682, filed on Feb. 20, 2019, the entire contents of each of which are incorporated herein by reference.

BACKGROUND

Technical Field

The present invention relates to vocoder technology for generating waveforms from acoustic features in a frequency domain.

Description of Related Art

Various vocoders are known to generate time-domain waveforms, based on acoustic features in a frequency domain. For example, a WORLD vocoder recited in Non-Patent Document 1 (Masanori Morise, Fumiya Yokomori, and Kenji Ozawa, "WORLD: A vocoder-based high-quality speech synthesis system for real-time applications," IEICE Transactions on Information and Systems, 99:18771884, 2016.) receives, as acoustic features, (i) a pitch (F0) of a series of waveform spectra, (ii) a series of spectral envelopes, and (iii) aperiodic parameters, and generates a waveform corresponding to the acoustic features.

Recently, there have been proposed neural vocoders using a neural network. For example, a WaveNet vocoder recited in Non-Patent Document 2 (Tamamori, Akira, et al., "Speaker-dependent WaveNet vocoder.," Proc. Interspeech., Vol. 2017, 2017.) receives acoustic features such as a Mel spectrogram or acoustic features similar to those used by the WORLD vocoder for generating a waveform, and generates a high-quality waveform in accordance with the received acoustic features.

The neural vocoder described in Non-Patent Document 2 is able to generate a waveform of a higher quality than that generated by the standard vocoder illustrated in Non-Patent Document 1. Generally, two types of acoustic features are received by a standard vocoder or a neural vocoder: (i) a first type representative of harmonic components of a series of waveform spectra, such as WORLD features, in the form of a series of spectral envelopes and a pitch; and (ii) a second type directly representative of a series of waveform spectra, such as a Mel spectrogram, or the like.

Due to the form used in the first type, it is not possible for an acoustic feature to represent a deviation of each harmonic component from a corresponding multiple of a fundamental frequency. Further, it is not possible to provide sufficient information, such as aperiodic parameters representative of inharmonic components. Accordingly, it is difficult to improve a quality of generated waveforms The second type of acoustic features has a drawback in that it is not possible to change with ease a feature amount. In many cases, such as for vocal cords and vocal tract in speech, or a reed and a tube in a woodwind instrument, in mechanisms of sound generation in nature, sound is constituted of a sound source and a filter. In some cases, it is useful to change characteristics of the sound source and characteristics of the filter. Of specific relevance here is changing a pitch, which constitutes one of the characteristics of the sound source, and changing an envelope, which constitutes one of the characteristics of the filter. In the second type of acoustic features, since the characteristics of the sound source and the filter are not separated, it is difficult to change them independently from each other.

SUMMARY

In consideration of the foregoing circumstances, an object of the present disclosure is to generate high-quality sound signals.

A computer-implemented sound signal generation method according to one aspect of the present disclosure includes: obtaining a first sound source spectrum of a sound signal to be generated; obtaining a first spectral envelope of the sound signal; and estimating fragment data representative of samples of the sound signal based on the obtained first sound source spectrum and the obtained first spectral envelope.

A computer-implemented generative model training method according to one aspect of the present disclosure includes: calculating a spectral envelope from waveform spectrum of a reference signal; calculating, by applying whitening to the waveform spectrum using the spectral envelope, a sound source spectrum; and training a waveform generation model to estimate, based on the sound source spectrum and the spectral envelope, fragment data representative of samples of a sound signal.

A sound signal generation system according to one aspect of the present disclosure includes at least one processor configured to execute a program to: obtain a first sound source spectrum of a sound signal to be generated; obtain a first spectral envelope of the sound signal; and estimate fragment data representative of samples of the sound signal based on the obtained first sound source spectrum and obtained first spectral envelope.

A non-transitory recording medium for storing a program executable by a computer to execute a method, according to one aspect of the present disclosure, includes: obtaining a sound source spectrum of a sound signal to be generated; obtaining a spectral envelope of the sound signal; and estimating fragment data representative of samples of the sound signal based on the obtained sound source spectrum and the obtained spectral envelope.

DESCRIPTION OF THE EMBODIMENTS

A: First Embodiment

Figure 1:
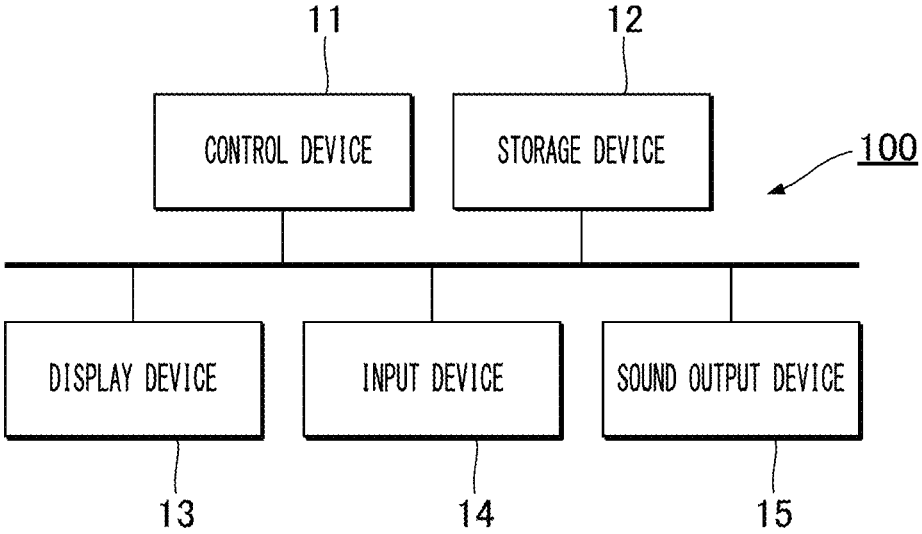
FIG. 1 is a block diagram of a hardware configuration of a sound signal generation system.

FIG. 1 is a block diagram showing an example configuration of a sound signal generation system 100 of the present disclosure. The sound signal generation system 100 is realized by a computer system that includes a control device 11, a storage device 12, a display device 13, an input device 14, and a sound output device 15. The sound signal generation system 100 is, for example, an information terminal, such as a portable phone, smart phone, personal computer, or other similar devices. The sound signal generation system 100 can be realized as a single device, or as a plurality of separately configured devices (e.g., a server client system).

The control device 11 comprises one or more processors that control each of the elements that constitute the sound signal generation system 100. Specifically, the control device 11 is constituted of different types of processors, such as a Central Processing Unit (CPU), Sound Processing Unit (SPU), Digital Signal Processor (DSP), Field Programmable Gate Array (FPGA), Application Specific Integrated Circuit (ASIC), and the like. The control device 11 generates a time-domain sound signal V representative of a waveform of the synthesized sound.

The storage device 12 comprises one or more memories that store programs executed by the control device 11 and various data used by the control device 11. The storage device 12 comprises a known recording medium, such as a magnetic recording medium, a semiconductor recording medium, or a combination of multiple types of recording media. It is of note that the storage device 12 can be provided separately from the sound signal generation system 100 (e.g., a cloud storage), and the control device 11 can write and read data to and from the storage device 12 via a communication network, such as a mobile communication network or the Internet. In other words, the storage device 12 can be omitted from the sound signal generation system 100.

The display device 13 displays calculation results of a program executed by the control device 11. The display device 13 is, for example, a display. The display device 13 can be omitted from the sound signal generation system 100.

The input device 14 accepts a user input. The input device 14 is, for example, a touch panel. The input device 14 can be omitted from the sound signal generation system 100.

The sound output device 15 plays sound represented by a sound signal V generated by the control device 11. The sound output device 15 is, for example, a speaker or headphones.

For convenience, a D/A converter, which converts the digital sound signal V generated by the control device 11 to an analog sound signal V, and an amplifier, which amplifies the sound signal V, are not shown. In addition, although FIG. 1 illustrates a configuration in which the sound output device 15 is mounted to the sound signal generation system 100, the sound output device 15 can be provided separate from the sound signal generation system 100 and connected to the sound signal generation system 100 either by wire or wirelessly.

Figure 2:
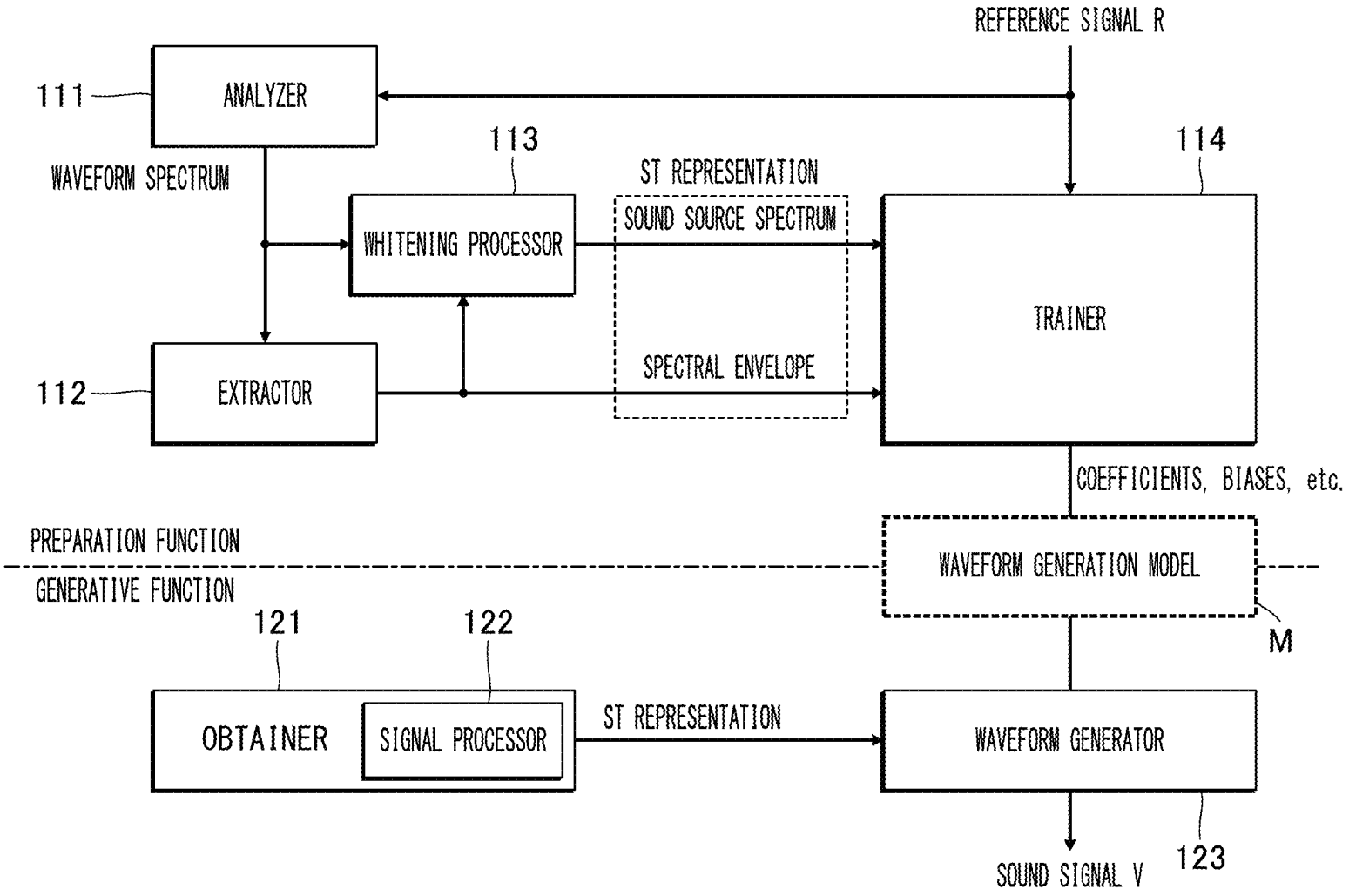
FIG. 2 is a block diagram showing a functional configuration of a control device.

FIG. 2 is a block diagram showing an example of a functional configuration of the control device 11. By executing a program stored in the storage device 12, the control device 11 realizes a generative function (implemented by an obtainer 121, a signal processor 122, and a waveform generator 123) that generates, by using a waveform generation model, a time-domain sound signal V representative of a sound wave in accordance with frequency-domain acoustic features. In addition, by executing a program stored in the storage device 12, the control device 11 realizes a preparation function (implemented by an analyzer 111, an extractor 112, a whitening processor 113, and a trainer 114) for preparing the waveform generation model used for the sound signal V. The functions of the control device 11 can be realized by a set of multiple devices (i.e., a system), or some or all of the functions of the control device 11 can be realized by dedicated electronic circuitry (e.g., signal processing circuitry).

Description will first be given of Source Timbre Representation (hereafter, "ST representation"), and a wave generation model M that generates a sound signal V in accordance with the ST representation. The ST representation is data representative of frequency-domain feature amount representative of a sound signal V. Specifically, the ST representation is data comprising a set of a sound source spectrum (a source) and a spectral envelope (a timbre). A case will be assumed in which a specific tone is added to a sound generated from a sound source. In this case, the sound source spectrum represents frequency characteristics of the sound produced by the sound source, and the spectral envelope represents frequency characteristics of the tone which is added to the sound. That is, the spectral envelope represents response characteristics of a filter that processes the sound.

The waveform generation model is a statistical model for generating a sound signal V to be generated, in accordance with a series of ST representations that are acoustic features of the sound signal V. The generative characteristics of the statistical model are defined by variables (e.g., coefficients, biases, etc.) that are stored in the storage device 12. The statistical model is a neural network that estimates for each sample cycle fragment data representative of a sample of the sound signal V, in accordance with the ST representation. The neural network can be a regression type, such as WaveNet (™), which estimates a probability density distribution of a current sample based on more than one sample of previous sound signals V. The algorithm for generating the probability density distribution is freely selectable. Examples of the algorithm include CNN type, RNN type, and a combination of the two. The algorithm can be one that includes an additional element, such as LSTM or ATTENTION. The variables of the waveform generation model M are established by training based on a training dataset prepared by a preparation function described below. The waveform generation model M in which the variables are established is used to generate a sound signal V, in a generative function described below.

To train the wave generation model M, the storage device 12 records sound signals (hereafter "reference signals") R representative of time-domain waveforms. Each reference signal R is a signal having a duration of several seconds, and comprises a series of samples of sample cycles (e.g., at a sample rate of 48 kHz). In general, waveform generation models synthesize sound signals in a similar manner to that used for training. To improve a quality of a sound signal, it is necessary to prepare a sufficient number of sound signals that have similar characteristics to those of the sound signal. To enable the waveform generation model to generate a variety of sound signals, it is necessary to prepare in advance an adequate number of various sound signals. The prepared sound signals are stored as reference signals R in the storage device 12.

Figure 3:
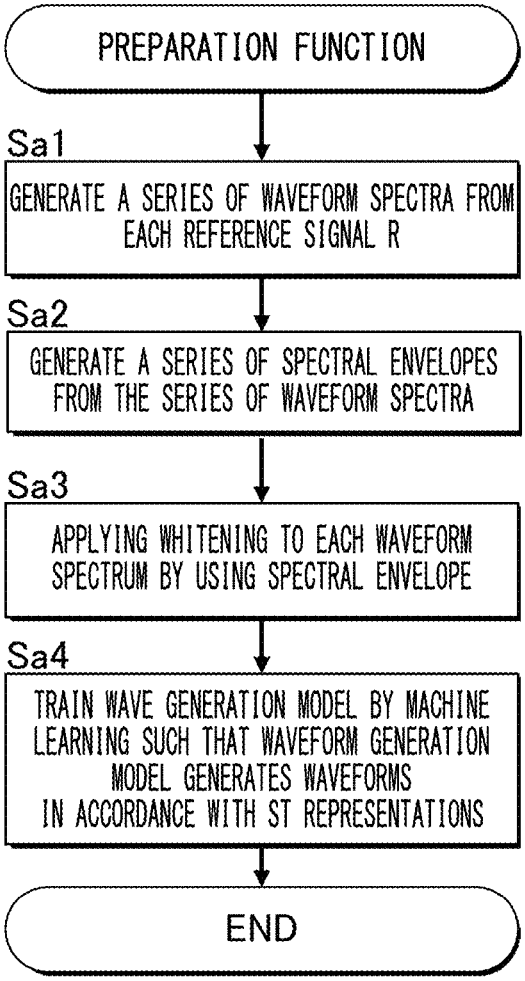
FIG. 3 is a flowchart showing a preparation process.

Next, the preparation function for training the waveform generation model will be described. The preparation function is realized by a preparation process shown in the flowchart in FIG. 3, and is executed by the control device 11. In one example, the preparation process is initiated by an instruction from a user of the sound signal generation system 100.

When the preparation process is started, the control device 11 (implemented by the analyzer 111) generates a series of frequency-domain spectra (hereafter, "a series of waveform spectra") from each of the reference signals R (Sa1). In one example, each waveform spectrum is an amplitude spectrum of the reference signal R. The control device 11 (implemented by the extractor 112) generates a series of spectral envelopes from the series of waveform spectra (Sa2). Further, the control device 11 (implemented by the whitening processor 113), by using each spectral envelope, applies whitening to a waveform spectrum corresponding to a spectral envelope, to generate a sound source spectrum (Sa3). Whitening refers to a process that is used to reduce differences in intensity between different frequencies in a waveform spectrum. Next, the control device 11 (implemented by the trainer 114) trains the waveform generation model by using a set of (i) each of the reference signals R and a series of sound source spectra, each series of sound source spectra corresponding to the reference signal R, and (ii) a series of spectral envelopes, each series of spectra envelopes corresponding to the reference signal R, and establishes the variables of the waveform generation model (Sa4).

Detailed description will now be given of the functions of the preparation process. For each reference signal R, the analyzer 111 shown in FIG. 2 calculates for each frame a waveform spectrum on the time axis. In one example, a known frequency analysis, such as Discrete Fourier Transform or the like, is used to calculate a waveform spectrum. In one example, a window width of Fourier transform is about 20 milliseconds, and a time difference between two consecutive frames is about 5 milliseconds.

The extractor 112 extracts a series of spectral envelopes from the series of waveform spectra of each reference signal R. Any known technique can be employed to extract the series of spectral envelopes. Specifically, the extractor 112 extracts peaks of harmonic components from each waveform spectrum, and calculates each spectral envelope of each reference signal R by spline interpolation of peak amplitudes. Alternatively, the extractor 112 can convert each waveform spectrum into cepstrum coefficients, and can inverse-convert the lower-order components thereof, and use each amplitude spectrum obtained by the inverse-conversion as the spectral envelope.

The whitening processor 113 calculates, for each spectral envelope, a series of sound source spectra by whitening (filtering) the corresponding reference signal R. Various known methods can be used to apply whitening. The simplest method is to calculate, using a logarithmic scale, each reference signal R by subtracting a spectral envelope of the reference signal R from the waveform spectrum of the reference signal R.

Figure 4:
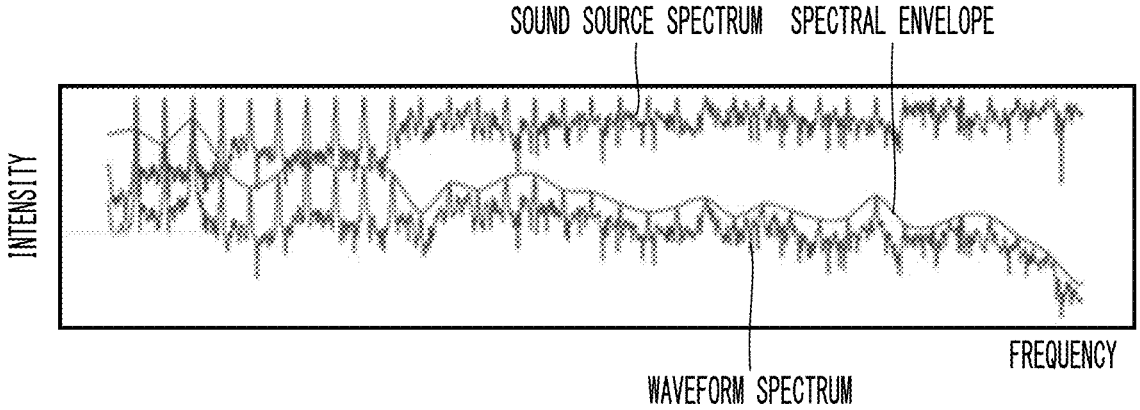
FIG. 4 is a diagram explaining whitening.

FIG. 4 shows an example of (i) a waveform spectrum calculated from a reference signal R, and (ii) an ST representation (i.e., a set of a spectral envelope and a sound source spectrum) calculated from the waveform spectrum. The number of dimensions of the sound source spectrum and the spectral envelope constituting the ST representation can be reduced by using Mel or Burke scales on the frequency axis. By using of the ST representation for training, in which the number of dimensions is reduced, the waveform generation model is trained such that the waveform generation model generates a sound signal V, in accordance with the ST representation in which the number of dimensions is reduced. Thus, a data size of a waveform generation model for generating a sound having a desired quality is reduced, and a learning efficiency is increased.

Figure 5:
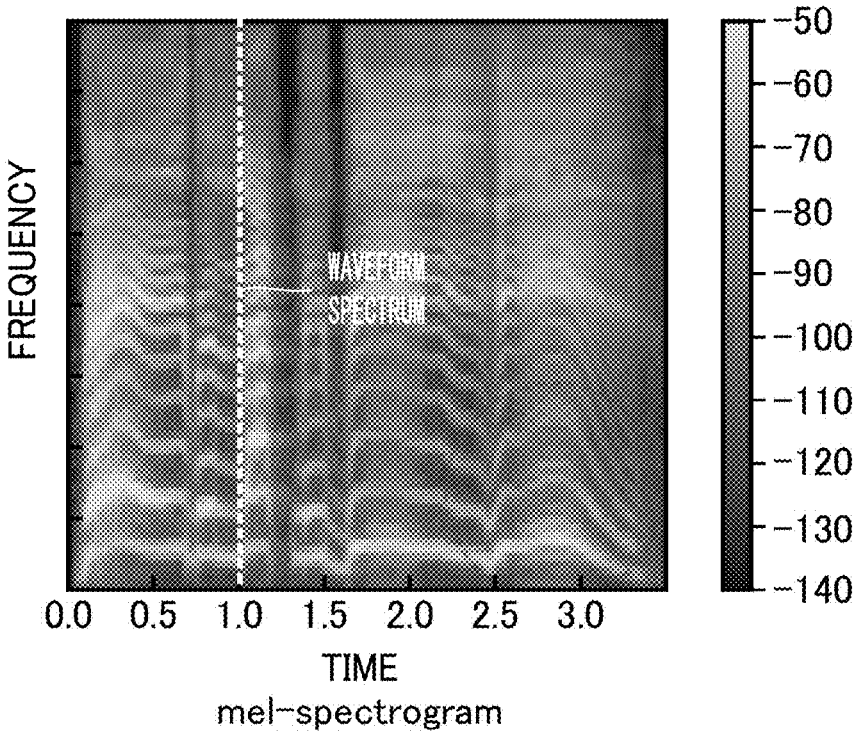
FIG. 5 is an example of a series of waveform spectra of a sound signal in a certain pitch.
Figure 6:
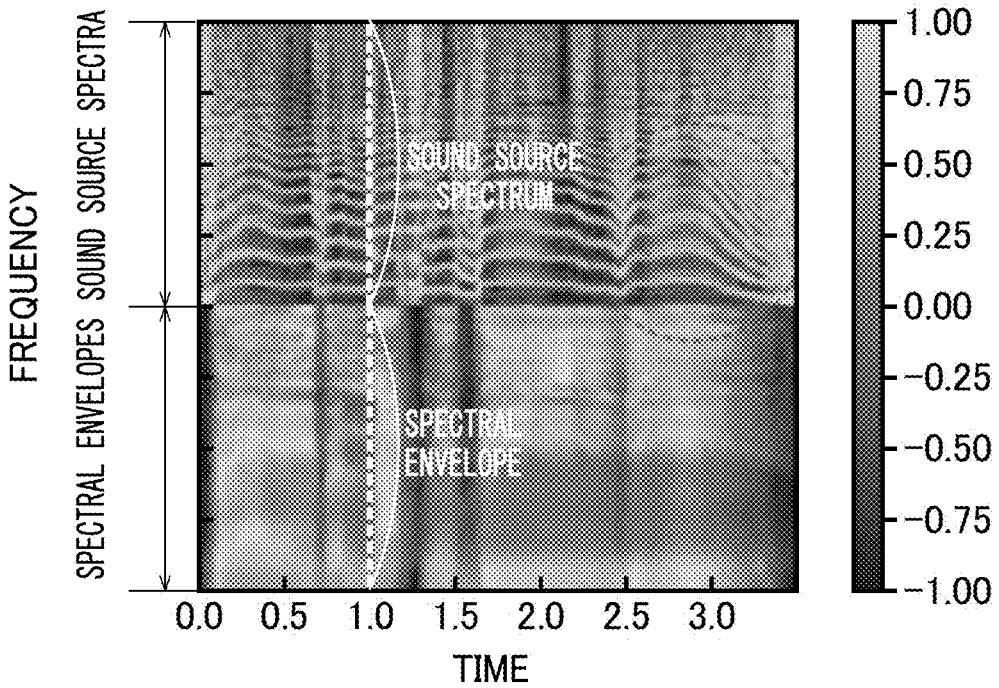
FIG. 6 is an example of a series of ST representations of a sound signal in a certain pitch.

FIG. 5 shows an example of a series of waveform spectra of a sound signal in the Mel scale. In FIG. 5, the horizontal axis represents a time axis, the vertical axis represents a frequency axis, and the dashed line represents a waveform spectrum at a certain time on the time axis. FIG. 6 shows an example of a series of ST representations for the sound signal in the Mel scale. The upper part of FIG. 6 represents the series of the sound source spectra. In the upper part, the horizontal axis represents a time axis, the vertical axis represents a frequency axis, and the dashed line represents a sound source spectrum at a certain time on the time axis. The lower part of FIG. 6 represents the series of the spectral envelopes. In the lower part, the horizontal axis represents a time axis, the vertical axis represents a frequency axis, and the dashed line represents a spectral envelope at a certain time on the time axis The trainer 114 shown in FIG. 2 trains the waveform generation model. Each unit data used for the training comprises (i) one reference signal R, and (ii) a sound source spectrum and a spectral envelope calculated from the reference signal R. Unit data are prepared from reference signals R stored in the storage device 12. First, the trainer 114 divides the unit data into a training dataset for training the waveform generation model and a test dataset for testing the waveform generation model. A majority of the unit data are used as a training dataset with the remainder being used as a test dataset.

Figure 7:
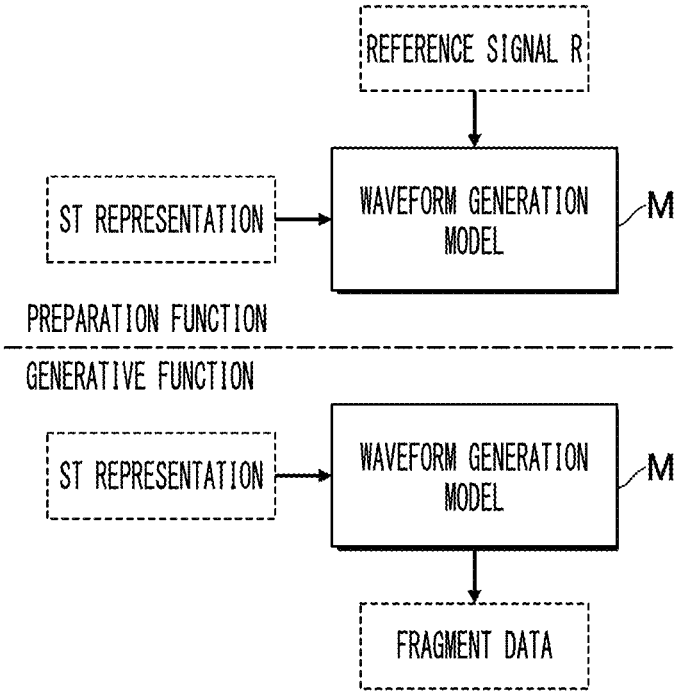
FIG. 7 is a diagram explaining a trainer and a waveform generator.

As shown in the upper part of FIG. 7, the trainer 114 trains the waveform generation model, using the training dataset. The waveform generation model of this embodiment receives an ST representation, and estimates for sample cycles (time t) fragment data representative of a sample of a sound signal V. Here, the fragment data to be estimated can represent a probability density distribution of the sample, or can be a value of the sample.

The trainer 114 sequentially inputs into the waveform generation model the series of ST representations of the training dataset at time t, thereby causing the waveform generation model to estimate fragment data in accordance with the series of ST representations. The trainer 114 calculates a loss function L based on the estimated fragment data and the sample at time t in a reference signal R. The trainer 114 optimizes the variables of the waveform generation model such that a sum of a series of loss functions L within a predetermined period is minimized. In a case where the fragment data represent the probability density distribution, the loss function L is obtained by reversing signs of the log-likelihood of the probability density distribution. In a case where the fragment data comprise samples, the loss function L is the square error between the samples and the samples of the reference signal R, for example. The trainer 114 repeats the training with the training dataset until the value of the loss function L calculated for the test dataset is reduced to have a sufficiently small value, or the change in the loss function L at each reputation is sufficiently reduced. The established waveform generation model has learned the relationship that potentially exists between (i) a series of ST representations in pieces of unit data, and (ii) reference signals R. By using this waveform generation model, it is possible to generate high quality sound signals V for an unknown series of ST representations.

Figure 8:
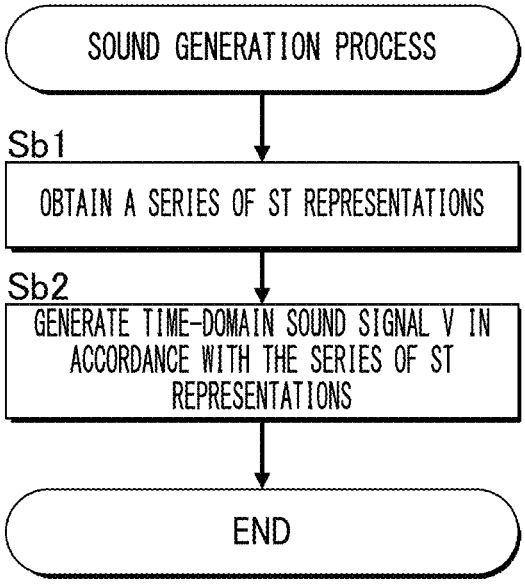
FIG. 8 is a flowchart of a sound generation process.

Next, description will be given of the generative function that generates sound signals V using the waveform generation model described above. The generative function is realized by execution of a sound generation process as shown in the flowchart in FIG. 8, and carried out by the control device 11. In one example, the sound generation process is initiated by an instruction from the user of the sound signal generation system 100.

When the sound generation process is started, the control device 11 (the obtainer 121) obtains a series of ST representations (a series of sound source spectra and a series of spectral envelopes) (Sb1). At step Sb1, the control device 11 (the signal processor 122) can process the series of ST representations. Next, the waveform generator 123 uses the waveform generation model to generate a sound signal V in accordance with the series of ST representations (Sb2).

Detailed description will now be given of each function of the sound generation process. The obtainer 121 obtains a series of ST representations of a sound signal V to be generated. Specifically, the obtainer 121 obtains the series of ST representations by utilizing an automatic performance player function of score data shown in FIG. 9.

Figure 9:
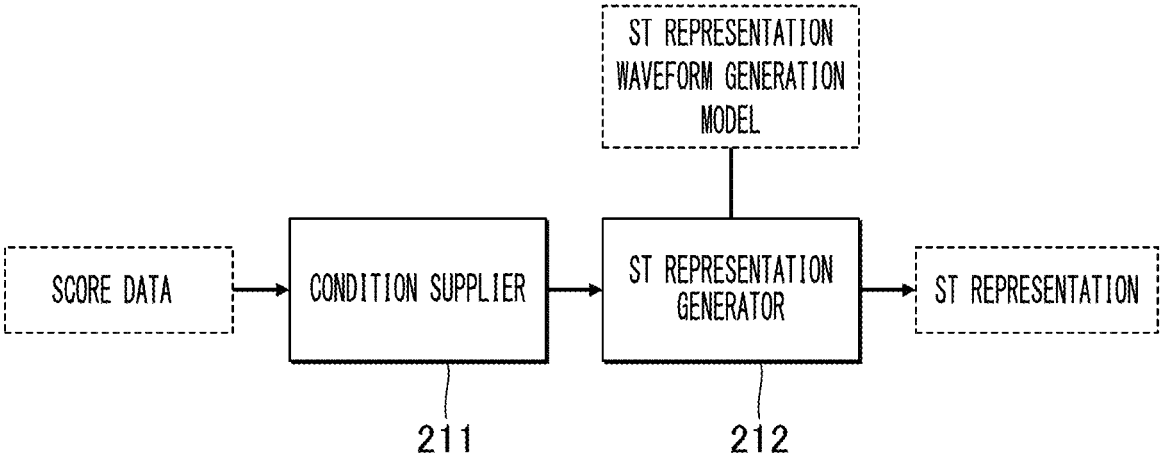
FIG. 9 is a diagram explaining an automatic performance function that generates a series of ST representations.

FIG. 9 is a diagram explaining a process of generating a series of ST representations corresponding to score data, by utilizing the automatic performance player function. The automatic performance player function can be realized by use of an external automatic performance player device, or can be realized by automatic performance player software executed by the control device 11. In one example, the automatic performance player software is an application program that is executed in parallel with the sound generation process using multitasking.

The automatic performance function is a function that generates, by carrying out automatic performance playing of score data, a series of ST representations corresponding to the score data, and is realized by a condition supplier 211 and an ST representation generator 212. On the basis of score data including a series of notes, the condition supplier 211 sequentially generates control data representative of speech conditions (a pitch, start, stop, etc.) of a sound signal V, the speech conditions corresponding to each of the notes. The ST representation generation model is a stochastic model that includes one or more neural networks. Due to pre-training with the training dataset, the ST representation generation model has learned a relationship that potentially exists between (i) control data of respective various notes, and (ii) ST representations of the sound signal V to be played back, in accordance with the notes. The ST representation generator 212 uses the ST representation generation model to generate a series of ST representations in accordance with the series of control data supplied from the condition supplier 211.

The obtainer 121 of the first embodiment includes a signal processor 122. The signal processor 122 processes the series of original ST representations generated by the automatic performance player function. Specifically, the signal processor 122 applies a pitch change to a series of sound source spectra in a certain pitch in a series ST representations, to output a series of ST representations that includes a series of sound source spectra in another pitch. Alternatively, the signal processor 122 applies filtering, which emphasizes a high frequency range, to a series of spectral envelopes of the series of ST representations, to thereby output a series of ST representations that includes the series of spectral envelopes with the emphasized high frequency range.

The waveform generator 123 receives the series of ST representations obtained by the obtainer 121. As shown in the lower part of FIG. 7, the waveform generator 123 estimates for each sample cycle (time t) fragment data in accordance with a corresponding ST representation (including a sound source spectrum and a spectral envelope), using the waveform generation model. In a case where the fragment data represent the probability density distribution, the waveform generator 123 generates a random number that follows the probability density distribution, and outputs the random number as a sample of the sound signal V at time t. In a case where the estimated fragment data comprise a sample, the waveform generator 123 outputs the sample as is as a sample of the sound signal V at time t.

In the manner described above, in accordance with the time series of the ST representations generated from the score data, a sound signal V, which represents sound produced by playing a series of notes of the score in the score data, is generated. The sound signal V generated here is estimated from the obtained series of ST representations (a series of sound source spectra and a series of spectral envelopes). Accordingly, a shift in frequencies of the harmonic components is reproduced, and the sound signal V with high quality out-of-inharmonic components is generated. Control of the characteristics of the ST representations is easier than that of the series of waveform spectra, such as Mel spectrograms. Since the waveform generation model directly estimates the sound signal V from the combination of the series of sound source spectra and the series of spectral envelopes of the series of ST representations (without synthesizing the two), it is possible to efficiently generate sounds in nature generated by the generative mechanism with a sound source and a filter.

B: Second Embodiment

The sound signal generation system 100 of the first embodiment generates a sound signal V, in accordance with a series of ST representations generated from a series of notes of score data. However, the sound signal V can be generated in accordance with the series of ST representations generated by other methods, such as generating the series of ST representations from a series of notes played with a musical keyboard.

In the second embodiment, description will be given of an example of utilizing the sound signal generation system 100 as a so-called pitch shifter, which changes a pitch of a sound signal of a certain pitch to be input (hereafter "input sound signal") and outputs a sound signal V in another pitch. The functional configuration of the second embodiment is the same as that of the first embodiment (FIG. 2). However, the second embodiment differs from the first embodiment in that the obtainer 121 obtains a series of ST expressions from a pitch shifter function shown in FIG. 10 instead of the automatic performance player function shown in FIG. 9.

Figure 10:
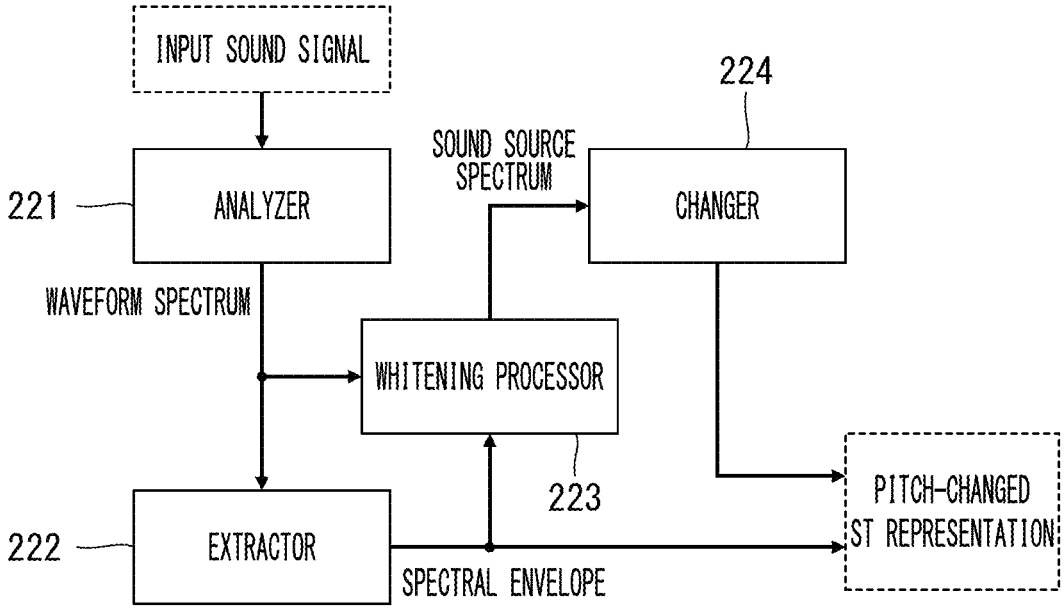
FIG. 10 is a diagram explaining a pitch shifter function.

As for the pitch shifter function shown in FIG. 10, functions of an analyzer 221, an extractor 222 and a whitening processor 223 are the same as those of the analyzer 111, the extractor 112 and the whitening processor 113 described above, respectively. The analyzer 221 estimates, from an input sound signal, a series of waveform spectra thereof. The extractor 222 calculates, from each waveform spectrum, a spectral envelope of the input sound signal. The whitening processor 223 applies whitening to each waveform spectrum with the corresponding spectral envelope, to calculate a sound source spectrum of the input sound signal.

A changer 224 having the pitch shifter function receives the series of sound source spectra from the whitening processor 223, in the same manner as the signal processor 122. The changer 224 changes, by the pitch change, each sound source spectrum of a certain pitch (hereafter, "first pitch") to a sound source spectrum of another pitch (hereafter, "second pitch"). The specific technique used for the pitch change is freely selectable. For example, the pitch change described in U.S. Pat. No. 9,286,906 B2 (corresponding to Japanese Patent No. 5,772,739), which is herein incorporated by reference, is used for the changer 224. Specifically, the changer 224 applies the pitch change to the sound source spectrum of the first pitch while maintaining the components between the harmonics, to calculate the sound source spectrum of the second pitch. In other words, by this pitch change technique, near each harmonic component of a spectrum, sideband spectral components (subharmonics) are generated by frequency modulation or amplitude modulation. Even after the pitch change, differences between the frequencies of the sideband spectral components and the frequencies of the harmonic components are retained as they are in the series of sound source spectra of the first pitch.

Alternatively, another technique is described below. First, a waveform segment corresponding to the sound source spectrum in the first pitch can be resampled for use as a waveform segment corresponding to the sound source spectrum in the second pitch. Thereafter, short-time Fourier transform can be applied to the waveform segment to calculate a spectrum for each frame, and then a reverse expansion/compression for cancelling a time-expansion/compression having resulted due to the resampling can be applied to the calculated series of spectra. Further, the whitening can be applied to the spectra obtained by the reverse expansion/compression, using the series of spectral envelopes. By this method, the modulation frequency is subject to conversion with the same ratio as used in the pitch change. In a case that a waveform to be processed has a pitch period that is a constant multiple of the modulation period, it is possible to calculate a sound source spectrum that corresponds to the sound source spectrum obtained by the pitch change where the relation between the pitch period and the modulation frequency is maintained.

Figure 11:
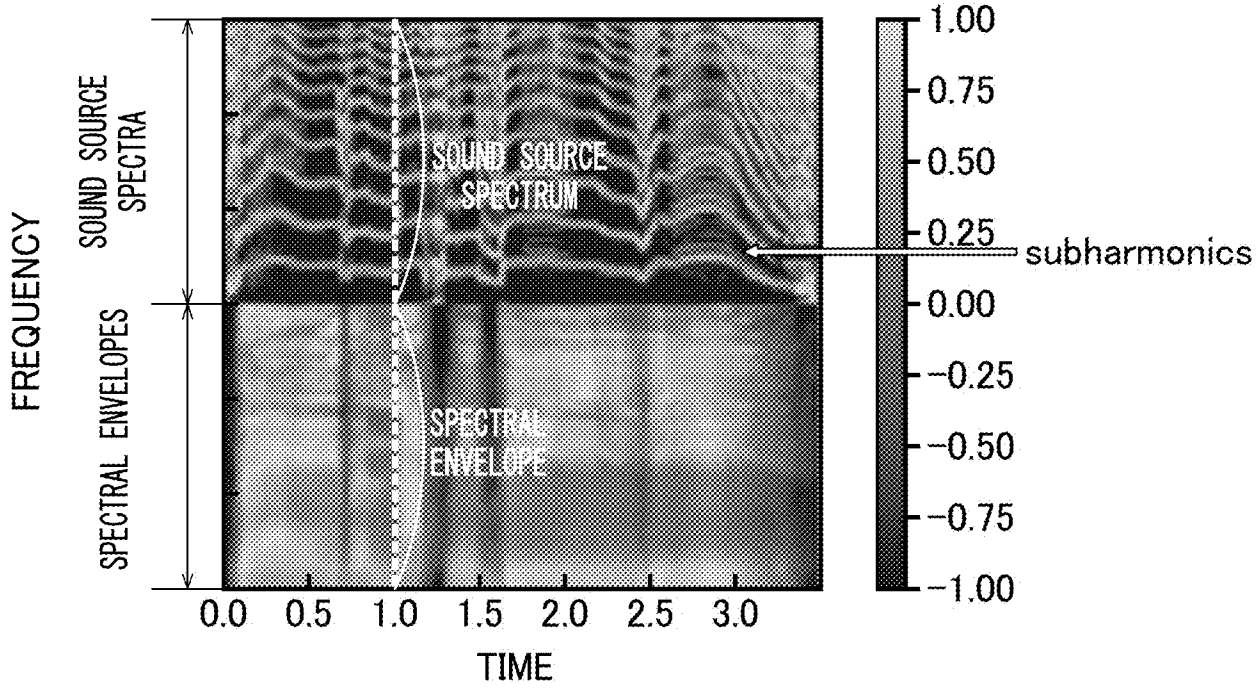
FIG. 11 is an example of a series of ST representations of a sound signal.

The pitch-changed ST representation is obtained by the combination of the pitch-changed sound source spectrum and the spectral envelope from the extractor 222. A series of ST representations that is obtained by changing, by the pitch change, a pitch of the series of ST representations shown in FIG. 6 to a higher pitch thereof is illustrated in FIG. 11. A series of sound source spectra in a higher pitch, shown in the upper part of FIG. 11, is obtained by applying the pitch change to the series of sound source spectra in the pitch shown in FIG. 6. In the upper part, the horizontal axis represents a time axis, the vertical axis represents a frequency axis, and the dashed line represents a sound source spectrum at a certain time on the time axis. A series of spectral envelopes shown in the lower part of FIG. 11 is the same as that shown in FIG. 6. In the lower part, the horizontal axis represents a time axis, the vertical axis represents a frequency axis, and the dashed line represents a spectral envelope at a certain time on the time axis.

The obtainer 121 of the second embodiment obtains the series of ST representations of the input sound signal to which the pitch change has been applied by the pitch shifter function described above. The waveform generator 123 generates a sound signal V in accordance with the series of ST representations, by using the waveform generation model. The sound signal V generated here is a signal in which the pitch of an input sound signal has been shifted from the first pitch to the second pitch. As a result of the pitch shifting, it is possible to obtain an input sound signal of the second pitch in which the modulation components of each harmonic of the input sound signal of the first pitch are not lost.

C: Third Embodiment

In the generative function of the first embodiment shown in FIG. 2, a sound signal V is generated based on a series of ST representations generated from score data. However, the condition supplier 211 and the ST representation generator 212 can be configured to perform real-time processing. In this case, a generator 117 can be configured to generate a sound signal V in real time in accordance with the series of ST representations generated in real time from a series of notes being played with a musical keyboard.

A sound signal V synthesized by the sound signal generation system 100 is not limited to instrumental sounds or voices. Any sound that contains a stochastic element in a process of generating a sound, such as animal voices or sounds of nature (e.g., a sound of wind, a sound of wave, etc.) can be synthesized by the sound signal synthesis system 100.

The foregoing functions of the sound signal generation system 100 are realized by the cooperation of the single or multiple processors constituting the control device 11 and the program stored in the storage device 12. The program of the present disclosure can be stored in a computer-readable recording medium, and this recording medium can be distributed and can be installed on a computer.

In one example, the recording medium is a non-transitory recording medium, preferable examples of which include an optical recording medium (optical disc), such as a CD-ROM. However, the recording medium can be any recording medium, such as a semiconductor recording medium or a magnetic recording medium. Here, a concept of the non-transitory recording medium includes any recording medium except transitory, propagating signals. Volatile recording mediums are not excluded. In a case where a distribution apparatus distributes the program via a communication network, the non-transitory recording medium corresponds to a storage device that stores the program in the distribution apparatus.

DESCRIPTION OF REFERENCE SIGNS

100 . . . sound signal generation system, 11 . . . control device, 12 . . . storage device, 13 . . . display device, 14 . . . input device, 15 . . . sound output device, 111 . . . analyzer, 112 . . . extractor, 113 . . . whitening processor 114 . . . trainer, 121 . . . obtainer, 122 . . . signal processor, 123 . . . waveform generator, 211 . . . condition supplier, 212 . . . ST representation generator, 221 . . . analyzer, 222 . . . extractor, 223 . . . whitening processor, 224 . . . changer.

What is claimed is:

1. A computer-implemented sound signal generation method comprising:

obtaining a first sound source spectrum of a sound signal to be generated;

obtaining a first spectral envelope of the sound signal; and estimating fragment data representative of samples of the sound signal based on the obtained first sound source spectrum and the obtained first spectral envelope using a waveform generation model that has learned a relationship between (i) a second sound source spectrum of a reference signal and a second spectral envelope of the reference signal as input data to the waveform generation model, and (ii) the reference signal as output data from the waveform generation model.

2. The computer-implemented sound signal generation method according to claim 1, wherein the obtained first spectral envelope is an envelope of waveform spectrum of the sound signal.

3. The computer-implemented sound signal generation method according to claim 2, wherein the obtained first sound source spectrum is a spectrum obtained by applying whitening to the waveform spectrum, using the obtained first spectral envelope.

4. A computer-implemented generative model training method comprising:

calculating a spectral envelope from waveform spectrum of a reference signal;

calculating, by applying whitening to the waveform spectrum using the spectral envelope, a sound source spectrum; and training a waveform generation model to estimate, based on the sound source spectrum and the spectral envelope, fragment data representative of samples of a sound signal, wherein the waveform generation model learns a relationship between (i) the sound source spectrum of the reference signal and the spectral envelope of the reference signal as input data to the waveform generation model, and (ii) the reference signal as output data from the waveform generation model.

5. A sound signal generation system comprising:

at least one processor configured to execute a program to:

obtain a first sound source spectrum of a sound signal to be generated;

obtain a first spectral envelope of the sound signal; and estimate fragment data representative of samples of the sound signal based on the obtained first sound source spectrum and the obtained first spectral envelope using a waveform generation model that has learned a relationship between (i) a combination of a second sound source spectrum and a second spectral envelope of a reference signal, and (ii) the reference signal.

6. The sound signal generation system according to claim 5, wherein the obtained first spectral envelope is an envelope of waveform spectrum of the sound signal.

7. The sound signal generation system according to claim 6, wherein the obtained first sound source spectrum is a spectrum obtained by applying whitening to the waveform spectrum, using the obtained first spectral envelope.

8. A non-transitory recording medium for storing a program executable by a computer to execute a method comprising:

obtaining a sound source spectrum of a sound signal to be generated;

obtaining a spectral envelope of the sound signal; and estimating fragment data representative of samples of the sound signal based on the obtained sound source spectrum and the obtained spectral envelope using a waveform generation model that has learned a relationship between (i) a combination of a second sound source spectrum and a second spectral envelope of a reference signal, and (ii) the reference signal.

* * * * *